US005617124A

United States Patent [19]

Taylor et al.

[11] Patent Number: 5,617,124

[45] Date of Patent: Apr. 1, 1997

[54] SELF-CLEANING SERVICE STATION FOR INKJET PRINTING MECHANISMS

[75] Inventors: Bret Taylor; William S. Osborne, both of Vancouver, Wash.

[73] Assignee: Hewlett-Packard Company, Palo Alto, Calif.

[21] Appl. No.: 218,391

[22] Filed: Mar. 25, 1994

[51] Int. Cl.[6] ..... B41J 2/165

[52] U.S. Cl. ..... 347/35; 347/36

[58] Field of Search ..... 347/36, 33, 35, 347/29

[56] References Cited

U.S. PATENT DOCUMENTS

| | | | |
|---|---|---|---|
| 4,567,494 | 1/1986 | Taylor | 346/140 R |
| 4,935,753 | 6/1990 | Lehmann et al. | 346/140 |
| 5,027,134 | 6/1991 | Harmon et al. | 347/29 |
| 5,081,472 | 1/1992 | Fisher | 346/140 |
| 5,103,244 | 4/1992 | Gast et al. | 347/33 |
| 5,115,250 | 5/1992 | Harmon et al. | 347/33 |
| 5,155,497 | 10/1992 | Martin et al. | 347/33 |

FOREIGN PATENT DOCUMENTS

| | | | |
|---|---|---|---|
| 9045163 | 3/1984 | Japan | 347/33 |
| 9209876 | 11/1984 | Japan | 347/33 |

OTHER PUBLICATIONS

English Language Translation of Japan No. 59–209876 ("Kogyo"), already of record.

English Language Translation of Japan No. 59–45163 ("Kobayashi"), already of Record.

*Primary Examiner*—John E. Barlow, Jr.

*Attorney, Agent, or Firm*—Flory L. Martin

[57] ABSTRACT

A service station for an inkjet printing mechanism has a moveable platform that receives waste ink which is occasionally discharged from an inkjet printhead. The printing mechanism has a drive mechanism which moves the platform between a first position for receiving the purged ink, and a second position for discharging the purged ink. The moveable platform may be configured as a rotating annular wheel, with a scraper positioned adjacent thereto for removing the discharged ink from the wheel. The platform may be provided by an endless belt conveyed over two or more rollers. At least one of the rollers may be located substantially under the printhead, and another roller may be located either near or remote from the printhead. Ink may be discharged from the belt using a scraper, and/or using specially contoured rollers. A method is also provided for cleaning an inkjet pen mounted for use in an inkjet printing mechanism.

7 Claims, 4 Drawing Sheets

FIG. 7
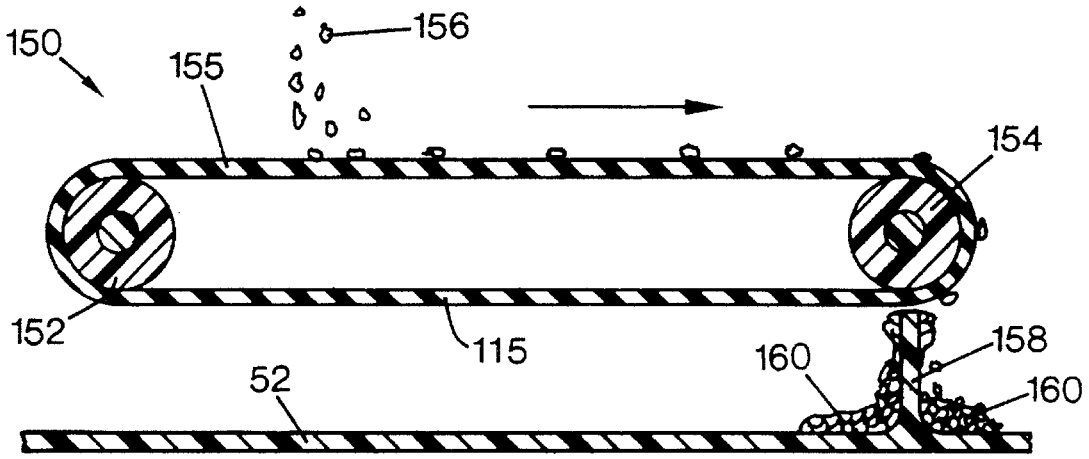
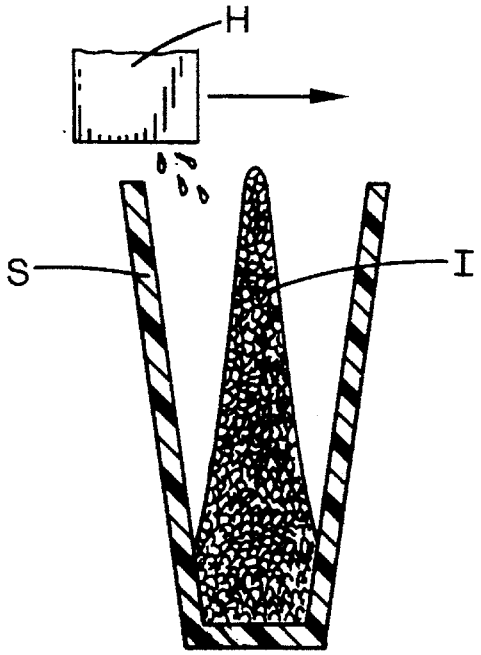
FIG. 8
PRIOR ART

SELF-CLEANING SERVICE STATION FOR INKJET PRINTING MECHANISMS

FIELD OF THE INVENTION

This invention relates generally to an inkjet printing mechanism, and more particularly to an apparatus and method for servicing and protecting inkjet printheads.

BACKGROUND OF THE INVENTION

Inkjet printing mechanisms use pens which shoot drops of ink onto a page. Each pen has a printhead formed with very small nozzles through which the ink drops are fired. To print an image, the printhead moves back and forth across the page shooting drops as it moves. To improve the clarity and contrast of the printed image, recent research has focused on improving the ink itself. For example, to provide darker blacks and more vivid colors, inks having a higher solid content than previous inks have been developed.

For example, the ink used in inkjet printers dries quickly, allowing these printers to use plain paper. However, the combination of small nozzles and quick-drying ink leaves the printheads susceptible to clogging, not only from dried ink or minute dust particles, such as paper fibers, but also from the solids within the new inks themselves.

Typically, a service station is mounted within the printer chassis, and serves to clean and protect the printhead. During operation, clogs in the printhead are periodically cleared by firing a number of drops of ink through each of the nozzles, with the waste ink being collected in a reservoir portion of the service station. This waste ink reservoir, which is often referred to as a "spittoon," has been a stationary device located adjacent to the nozzle caps and wipers of the service station. While stationary spittoons were suitable for the earlier inks, they suffer a variety of drawbacks when used with the newly developed inks, which have a higher solids content than the earlier inks.

Referring to FIG. 8, a vertical sectional view is shown of a conventional prior art spittoon S which has been receiving waste ink of the newer variety for a period of time. The rapidly solidifying waste ink has gradually accumulated into a stalagmite I. The ink stalagmite I may eventually grow to contact the printhead H, which could interfere with printhead movement, print quality, and/or contribute to clogging the nozzles. Indeed, stalagmites (not shown) may even form from ink deposits along the sides of the spittoon and they may grow to meet one another and clog the entrance to the spittoon. To avoid this phenomenon, conventional spittoons must be wide, often over 8 mm in width to handle a high solid content ink. This extra width increases the overall printer width, resulting in additional cost being added to the printer, both in material and shipping costs.

This stalagmite problem is particularly acute for a polymer or a wax based ink, such as an ink based on carnauba wax, or a polyamide. In the past, inkjet printers using polyamide-based inks have replaced the conventional spittoon of FIG. 8 with a sheet of flat plastic. The nozzles are periodically cleared by "spitting" the hot wax ink onto the plastic sheet. At regular intervals, an operator must remove this plastic sheet from the printer, flex the sheet over a trash can to remove the waste ink, and then replace the cleaned sheet in the printer. This cleaning step is particularly inconvenient for operators to perform on a regular basis.

The use of an operator-cleaned flexible sheet is not suitable for the new high solids ink. In comparison to the wax or polymer based inks, these new inks leave a waste which is quite dirty, due to the high amount of solids used to improve the contrast and quality of the printed images. Thus, operator intervention to regularly clean a high solids ink spittoon could lead to costly staining of clothing, carpeting, upholstery and the like.

Besides increasing the solid content, mutually precipitating inks have been developed to enhance color contrasts. For example, one type of color ink causes black ink to precipitate out of solution. This precipitation instantly fixes the black solids to the page, which prevents bleeding of the black solids into the color regions of the printed image. Unfortunately, if the mutually precipitating color and black inks are mixed together in a conventional spittoon, they do not flow toward a drain or absorbent material. Instead, once mixed, the black and color inks instantly coagulate into a gel, with some residual liquid being formed.

Thus, the mixed black and color inks have the drawbacks of both hot-melt inks, which have an instant solid build-up, and the aqueous inks, which tend to run and wick (flow through capillary action) into undesirable locations. To resolve the mixing problem, two conventional stationary spittoons are required, one for the black ink and one for the color inks. As mentioned above, these conventional spittoons must be wide to avoid clogging from stalagmites growing inward from the spittoon sides. Moreover, two spittoons would further increase the overall width of the printer, which undesirably adds to the overall size of the inkjet printer, as well as its weight and material cost to build.

SUMMARY OF THE INVENTION

According to one aspect of the invention, a service station is provided for an ink jet printing mechanism having an ink printhead for selectively dispensing ink which is occasionally purged from the printhead. The service station comprises a moveable platform having a surface positionable to receive ink purged from the printhead. The service station also has a drive mechanism coupled to move the platform between first and second positions for respectively receiving and discharging the purged ink.

According to another aspect of the present invention, a method is provided of cleaning an ink jet pen mounted for use in an ink jet printing mechanism. The method includes the steps of positioning the ink jet pen over a surface of a moveable service station platform, and purging a portion of the ink from the pen onto the platform surface. In a driving step, the platform is driven to a discharge location. In a discharging step, the purged ink is discharged from the platform surface at the discharge location.

An overall object of the present invention is to provide an inkjet printing mechanism which prints sharp vivid images without requiring operator intervention to regularly remove waste ink from the printing mechanism.

Another object of the present invention is to provide a service station for an inkjet printing mechanism which is substantially self-cleaning and occupies a relatively small physical space to provide a more compact printer unit.

A further object of the present invention is to provide a method of cleaning an inkjet pen mounted in a printing mechanism with a self-cleaning service-station.

BRIEF DESCRIPTION OF THE DRAWINGS

FIG. 7 is a side elevational view of a third embodiment of a self-cleaning service station of the present invention.

FIG. 8 is a side elevational view of a conventional spittoon portion of a prior art service station.

DETAILED DESCRIPTION OF THE PREFERRED EMBODIMENTS

Figure 1:
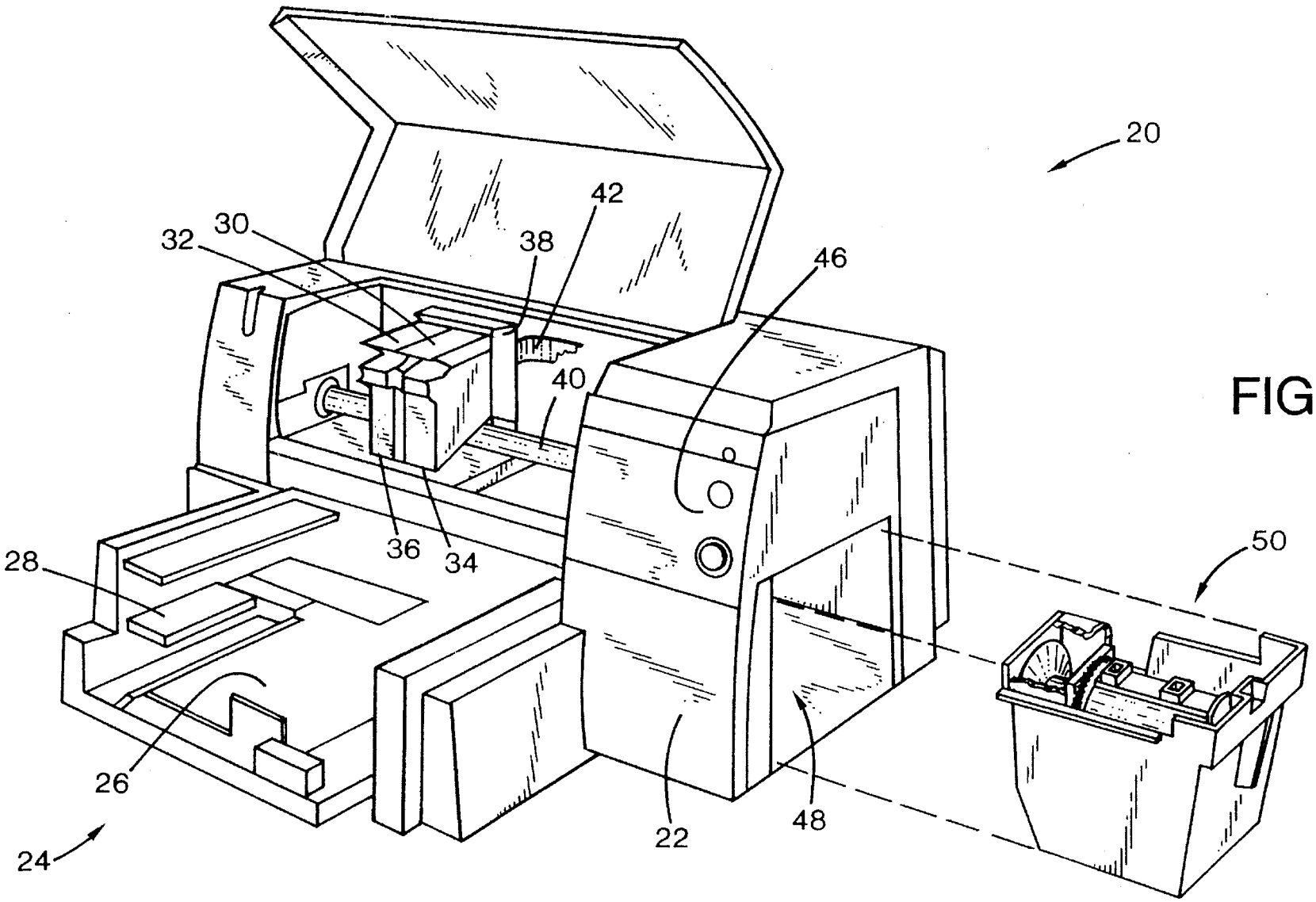
FIG. 1 is a perspective view of one form of an inkjet printing mechanism of the present invention incorporating a first embodiment of a self-cleaning service station of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office or home environment, for instance. Other inkjet printing mechanisms may embody the present invention, such as plotters, portable printing units, copiers, cameras, and facsimile machines, to name a few, but for convenience the concepts of the present invention are illustrated in the environment of an inkjet printer 20. While it is apparent that the printer components may vary from model to model, the typical inkjet printer 20 includes a chassis 22 and a print medium handling system 24 for supplying a print medium to the printer 20. The print medium may be any type of suitable sheet material, such as paper, card-stock, transparencies, mylar, foils, and the like, but for convenience, the illustrated embodiment is described using paper as the print medium. The print medium handling system 24 includes a feed tray 26, an output tray 28, and a series of rollers (not shown) for delivering the sheets of paper from the feed tray 26 into position for receiving ink from an inkjet cartridge, such as a color ink cartridge 30 and/or a black ink cartridge 32. The illustrated color cartridge 30 is a tri-color pen, although in some embodiments (not shown), a group of discrete monochrome pens may be used, or a single monochrome black pen 32 may be used.

The illustrated cartridges 30, 32 each include reservoirs for storing a supply of ink therein, although other ink supply storage arrangements, such as those having reservoirs mounted along the housing (not shown) may also be used. The cartridges 30, 32 have printheads 34, 36 respectively. Each printhead 34, 36 has bottom surface comprising an orifice plate (not shown) with a plurality of nozzles formed therethrough in a manner well known to those skilled in the art. Typically, the printheads 34, 36 are thermal inkjet printheads, although other types of printheads may be used, such as piezoelectric printheads. The printheads 34, 36 typically include a plurality of resistors (not shown) which are associated with the nozzles. Upon energizing a selected resistor, a bubble of ink is formed and then ejected from the nozzle and on to a sheet of paper in the print zone under the nozzle.

The cartridges or pens 30, 32 are transported by a carriage 38 which may be driven along a guide rod 40 by a conventional drive belt/pulley and motor arrangement (not shown). The pens 30, 32 selectively deposit one or more ink droplets on a sheet of paper in accordance with instructions received via a conductor strip 42 from a printer controller, such as a microprocessor (not shown), located within chassis 22. The controller generally receives instructions from a computer (not shown), such as a personal computer. The printhead carriage 38, as well as the carriage motor (not shown) and paper handling system drive motor (not shown) each operate in response to the printer controller, which operates manner well known to those skilled in the art. The printer controller also operates in response to user inputs provided through a key pad 46. A monitor (not shown) coupled to the computer may be used to display visual information to an operator, such as the printer status or a particular program being run on the computer. Personal computers, their input devices, such as a keyboard and/or a mouse device (not shown), and monitors are all well known to those skilled in the art.

Figure 2:
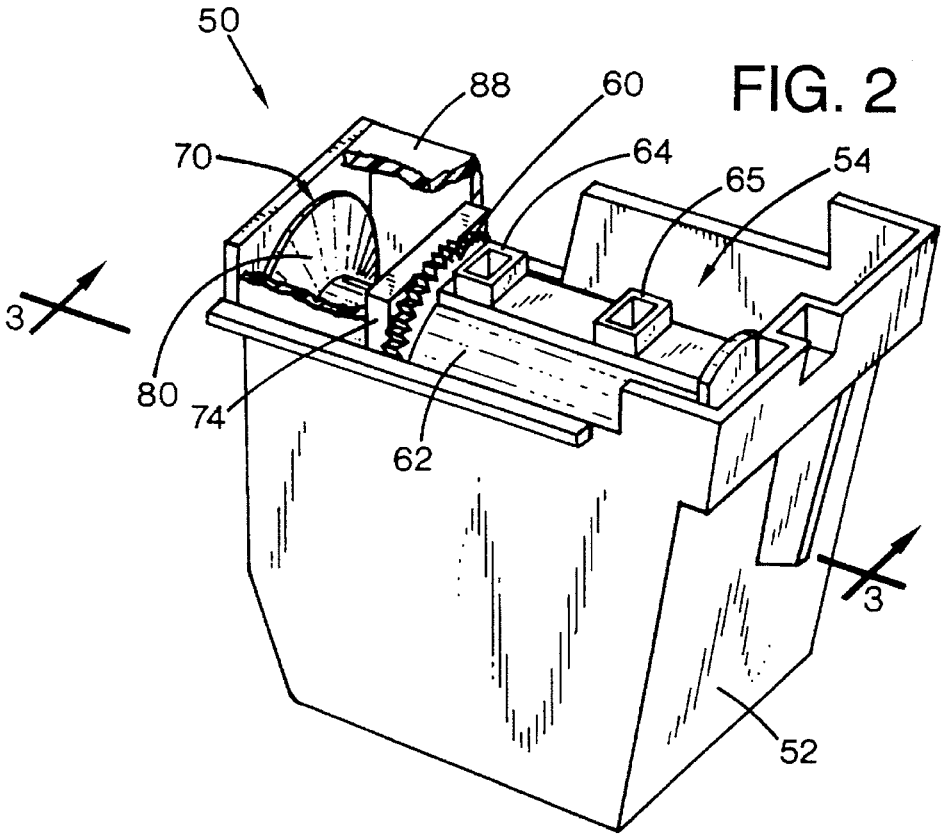
FIG. 2 is a perspective view of the self-cleaning service station of FIG. 1.
Figure 3:
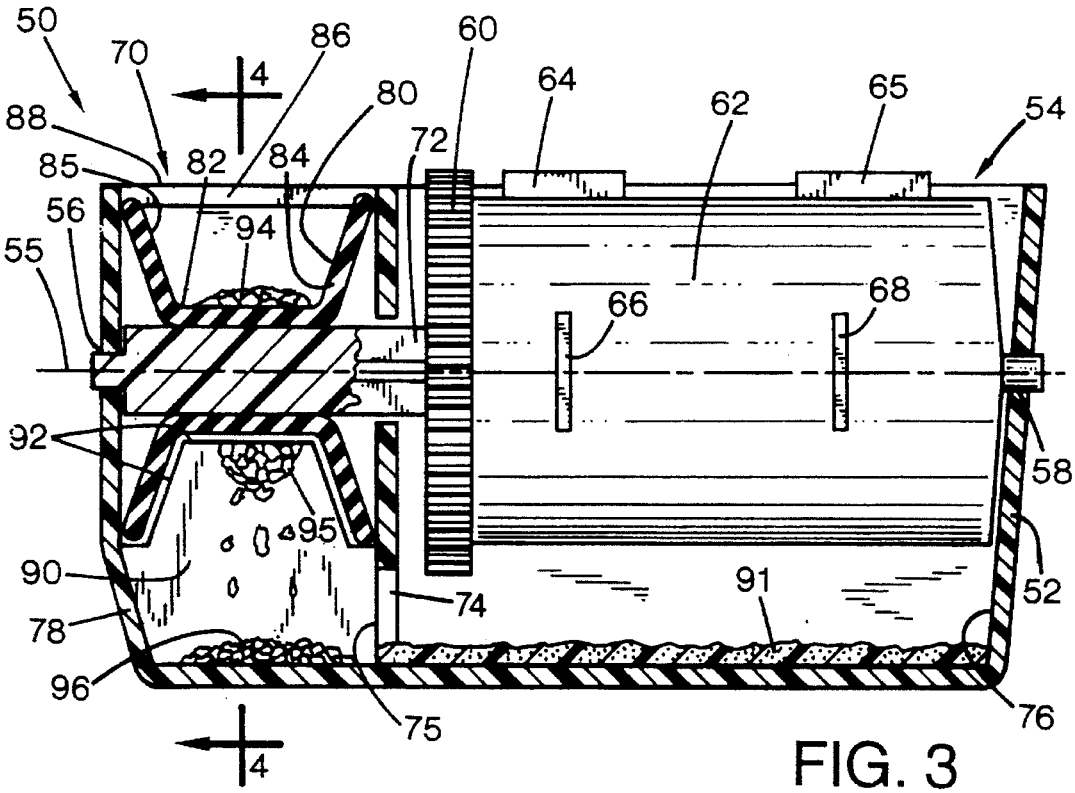
FIG. 3 is a front vertical elevational view taken along lines 3—3 of FIG. 2.
Figure 4:
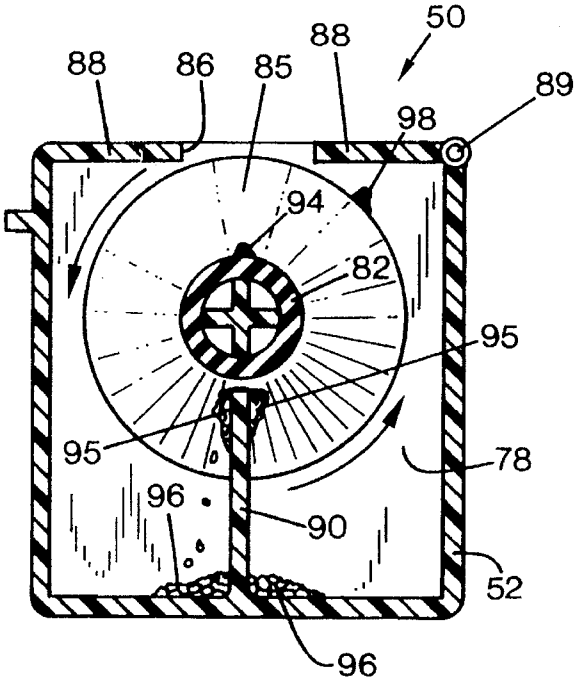
FIG. 4 is a side elevational view taken along lines 4—4 of FIG. 3.

Referring also to FIGS. 2–4, the printer chassis 22 has a chamber 48, configured to receive a service station 50, located at one end of the travel path of carriage 38. Preferably, the service station 50 is constructed as a modular device capable of being unitarily inserted into the printer 20, to enhance ease of initial assembly, as well as maintenance and repair in the field. The illustrated service station 50 has a frame 52 which may be slidably received within chamber 48 the printer chassis 22. However, it is apparent that the service station 50 may also be constructed with the station frame 52 integrally formed within the chassis 22.

The service station 50 has a tumbler portion 54 mounted to frame 52 for rotation about a first axis 55 with beatings 56, 58. The tumbler 54 may be driven by motor and gear or belt assembly (not shown), or through a separate motor (not shown) via a gear 60. The tumbler 54 includes a main body 62 upon which may be mounted conventional inkjet pen caps, such as a black ink cap 64 and a color cap 65. The body 62 also supports black and color ink wipers 66 and 68 for wiping the respective color and black printheads 34, 36. Other functions may also be provided on the main body 62, such as primers and the like, which are known to those skilled in the art. It is apparent that other arrangements may be used to index the pen capping, wiping, etc. functions rather than the tumbler main body 62. For example gears or linkages (not shown) known to those skilled in the art may be used for selectively engaging the service station equipment 64, 65 and 66, 68 with the respective printheads 34, 36. However, the tumbler concept illustrated in FIGS. 1–4 is preferred because of its ease of implementation and adaptability for modular use.

FIGS. 1–4 illustrate the first embodiment of the self-cleaning service station 50 as having a rotating annular trough or "ferris wheel" spittoon 70. The spittoon 70 receives ink which is spit from the black ink and color pens 30, 32 when they are positioned above the spittoon. The spittoon 70 is driven by gear 60 via a roller, first spindle or axle portion 72, which extends from the main body 62. The frame 52 and an intermediate wall 74 separate the service station 50 into a spittoon chamber 75 and a main servicing chamber 76. As shown in FIG. 3, the spittoon chamber 75 is located between wall 74 and a wall 78 of the frame.

The ferris wheel spittoon 70 has a moveable platform provided by an annular trough or "ferris wheel" 80. The wheel 80 has an annular bottom portion 82 and two side walls 84, 85, and is mounted to the axle 72 for rotation about axis 55. The wheel 80 receives ink purged from the printheads 34 and 36 through an opening 86 without contacting the printheads 34, 36 with the surface of the ferris wheel 80 for purging or any other servicing. The opening 86 is defined by an upper wall or lid 88, which may be a portion of, or pivoted at a hinge 89 to, the frame 52. Preferably, the wheel 80 is of an elastomeric or other resilient and flexible material, such as neoprene. The use of an elastomeric material is preferred to facilitate sealing the area between the wheel side walls 84, 86 and the frame walls 74 and 78, respectively. However, it is apparent that other types of material may also be used for wheel 80, such as various plastics which are flexible and resilient to provide a positive seal between the wheel 80 and walls of frame 52.

The spittoon 70 also has a scraper portion 90 for removing purged ink from the ferris wheel 80, as shown in FIG. 3. Adjacent the scraper 90, the main servicing chamber 76 may be lined with a liquid absorbent diaper 91, which may be of a felt, pressboard, sponge or other material. The diaper 91 absorbs liquids spit from the pens 30, 32. When both black and color inks are deposited in the spittoon 70, once mixed, these inks instantly coagulate into a gel, with some residual liquid being formed. This residual liquid may also be absorbed by the diaper 91.

In the illustrated embodiment, the scraper 90 is of a substantially rigid plastic material. The scraper 90 may be molded unitarily with the remaining portion of frame 52 for convenience, although it is apparent that the scraper 90 may be separately assembled into frame 52. The scraper portion 90 preferably has a scraping surface 92 conformed to roughly approximate the cross-sectional shape of the wheel 80, as shown in FIG. 3.

In operation, referring to FIGS. 3–4, recently spit ink 94 is collected along the wheel bottom surface 82. The tumbler 54 is rotated via a gear assembly (not shown) in contact with gear 60 until the majority of the discharged ink 94 is removed from the ferris wheel 80 by scraper 90. An accumulation of recently removed ink 95 may accumulate adjacent the upper edge 92 of the scraper 90. Eventually, this accumulated ink 94 will dry and fall from the scraper to form piles of dried ink solids 96 at the bottom of the spittoon chamber 75. Ink may also accumulate along the rim surface of the ferris wheel side walls 84, 85, such as ink accumulation 98 shown in FIG. 4. Advantageously, by selecting a relatively close spacing between the lid 88 and the walls 84, 85, the lid 88 scrapes the ink solids 98 from the wheel rims to prevent the solids 98 from touching the printheads 34, 36. As mentioned in the background portion, if left unattended, such ink residue 98 could contact the nozzle plate, potentially damaging or clogging the orifices of the printheads 34, 36.

Figure 6:
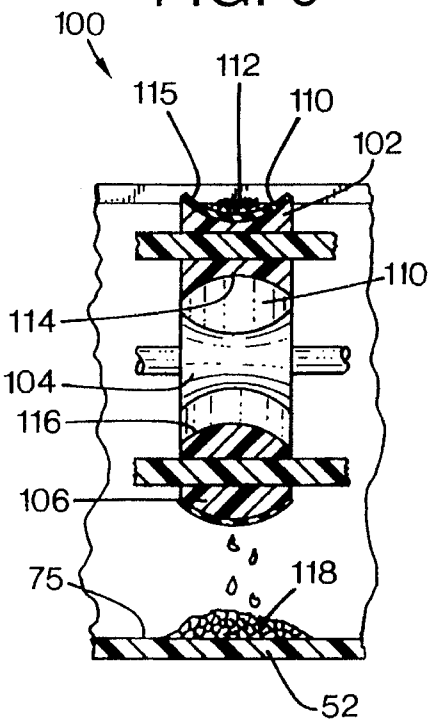
FIG. 6 is a front elevational view taken along lines 6—6 of FIG. 5.
Figure 5:
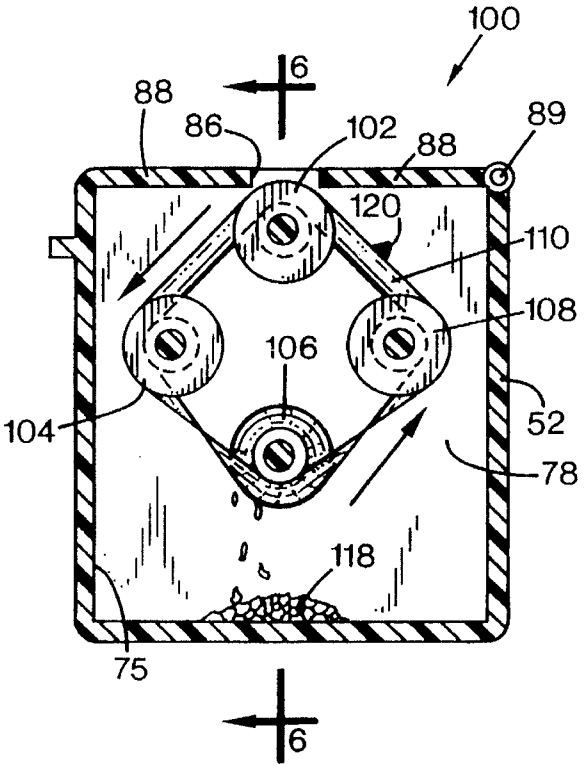
FIG. 5 is a side elevational view of a second embodiment of a self-cleaning service station of the present invention.

FIGS. 5 and 6 illustrate a second alternate embodiment of an inkjet spittoon 100 constructed in accordance with the present invention, which may be substituted for the ferris wheel spittoon 70 of FIGS. 1–4. The spittoon 100 comprises a multiroller spittoon having two or more spindles or rollers, here, having four rollers 102, 104, 106 and 108. A first one of the rollers 102–108 may be driven by gear 60 and the remaining rollers may be mounted between walls 74 and 78 for free pivoting. The rollers 102–108 support a moving platform comprising an endless belt 110, which may be constructed of an elastomer, polymer, plastic, fabric, or other flexible material.

In the spittoon 100, the mechanism for removing recently spit ink 112 from belt 110 comprises an ink removal device formed by the contours of rollers 102 and 106, rather than through the use of a scraper 90. In the illustrated embodiments, the roller 102 is positioned under opening 86 in the lid 88 to receive the purged ink 112 without contacting the printheads 34, 36 with the surface of the belt 110 for purging or any other servicing. The roller 102 has a concave surface 114 which forms a trough 115 in belt 110 for receiving the ink 112. To expel the ink 112 from belt 110, the lower discharge roller 106 has a convex surface 116 which flexes the belt 110 outwardly to dump the spent ink solids 112 into a refuse ink pile 118 along the lower surface of the spittoon chamber 75. Rollers 104 and 108 may be cylindrical or have configurations which are either concave or convex, but as illustrated, roller 104 is concave and roller 108 is convex. Furthermore, it is apparent that a scraper mechanism, such as scraper 90, may also be used in conjunction with the contoured first and second rollers 102, 106 to remove ink deposits from the belt 110. The rim of roller 102, thickness and width of belt 110, and the relative location of lid 88 to the edges of belt 110 may be selected to remove ink accumulations 120 from the belt edges, as described above with respect to FIG. 4 for the rim accumulation 98.

A third embodiment of a self-cleaning spittoon 150 is shown in cross-section in FIG. 7. The spittoon 150 may include two or more spendles or rollers, such as first and second roller 152 and 154 which are coupled together by an endless belt 155. Preferably, roller 152 may be coupled to the tumbler portion 54 to be driven by gear 60. In the illustrated embodiment, roller 152 is positioned below the frame lid opening (not shown) in the frame lid 88 to receive the ink 156 from printheads 30, 32 without contacting the printheads 34, 36 with the surface of the belt 155 for purging or any other servicing. The ink 156 travels along the upper surface of belt 155, and around discharge roller 154 where it encounters a scraper 158, and is scraped off as ink solids 160. Alternatively, the illustrated cylindrical rollers 152 and 152 may be replaced with concave and convex rollers, such as roller 102 and 106, respectively of FIGS. 5 and 6. In such an embodiment, the scraper 160 may be used in conjunction with roller 154 having a convex shape, or the scraper 160 may be omitted in such a contoured roller embodiment. The belt 155 may be as described above with respect to belt 110 regarding flexing.

One advantage of the spittoon embodiment 150 is that it receives ink in one portion of the printer adjacent roller 152, and expels the dried solids in a remote location adjacent roller 154. While the belt 155 is illustrated as being a substantially flat belt, it is apparent that it may be flexible to conform to the contours of rollers as described above with respect to FIGS. 5–6, or it may have side walls similar to walls 84 and 86 (FIG. 3).

According to another aspect of the illustrated embodiment, a method is also provided for cleaning an inkjet pen, such as pen 30 or 32, when mounted for use in an inkjet printer, such as printer 20. The method includes the steps of positioning the pen 30 or 32 over a moveable platform surface of the service station 70. This moveable platform may be provided by the ferris wheel 80, or belts 110 or 155. A portion of the ink is purged from the pen 30 or 32 onto the platform. The platform is then moved to a discharge location, illustrated here with the platforms being driven by rotating gear 60 or the at least one of the rollers 102–108 and 152–154. The discharge location is illustrated as adjacent scraper 90 (FIGS. 3–4), adjacent roller 106 (FIGS. 5–6), and adjacent roller 154 and scraper 158, if used (FIG. 7).

In a discharging step, the purged waste ink is discharged from the platform surface at the discharge location. As shown in FIGS. 3–4, the discharging is illustrated by scraper 90 scraping ink off of the ferris wheel 80. In FIGS. 5–6, discharging is accomplished by flexing the belt 110 using the convex contour 116 of roller 106. In FIG. 7, the scraper 158 provides the discharge mechanism, in addition to, or as an alternative to a convex profile for roller 154. That is, the contoured roller concept may be combined with the scraper concept (not shown) by forming the scraper upper surface (item 92 in FIG. 3) with a concave contour to compliment the convex contour of roller 106, for instance.

Thus, a variety of advantages are achieved using the movable platform spittoon of the present invention, for example in the various embodiments as illustrated in FIGS. 1–7. For instance, ink no longer accumulates into a stalagmite I as shown in FIG. 8 for the earlier conventional spittoon S. Instead, the waste ink is transported from a receiving location to a discharge location where it is broken off in small pieces 96, 118, 160. During periodic servicing of the printer 20, these waste ink solids 96, 118, 160 may be easily removed, and they are more compact for disposal than the large stalagmites I encountered in the prior art (FIG. 8). Thus, the packing density of a pile of short stalagmites formed as shown in FIGS. 3–7 is much less than that for the large stalagmite I shown in FIG. 8.

Furthermore, the use of a moveable platform spittoon allows for the accumulation of a greater number of ink solids than achieved with the stationary spittoon S of FIG. 8. As a result, the printer 20 may be operated for longer periods of time between servicing to remove accumulated ink solids. Additionally, accumulation of the ink solids 95 will not inhibit printhead performance as would be the case for high ink solids using the earlier FIG. 8 stationary spittoon S.

Moreover, the illustrated spittoons of FIGS. 1–7 may have a very narrow width, e.g. narrow in the axial direction parallel with the first axis 55. Indeed, the width of the ferris wheel 80, or the belt 110, 155 need only be as wide as the precision within which the ink may be spit into them, for instance, on the order of 2 mm, as opposed to 8 mm for spittoon S of FIG. 8. Thus, a narrower service station may be achieved, which reduces the overall size of printer 20 to reduce material costs, shipping and packing costs, and to provide a more compact printer 20 for the consumer.

The use of an elastomeric or other resilient material for the ferris wheel 80 of FIGS. 1–4 provides additional advantages. For example, the aqueous residue from the expelled ink 94 tends to run downwardly under the force of gravity, and to wick along corners and edges of the spittoon chamber 75. The elastomeric rims 84 and 86 of wheel 80 advantageously provide a liquid seal against walls 74 and 78, respectively. Even if liquid is lifted from the bottom portion of the chamber 75 by the rims 84 and 85 upwardly toward the lid 88, the rim seals will prevent this liquid from reaching the remaining service station equipment of the main body 62. That is, the rim 84 seals the opening in wall 74 through which the shaft 72 passes. Advantageously, the caps 64 and 65, the wipers 66 and 68, and any other service station component mounted on the main body 62 are kept clean to maintain print quality.

I claim:

1. A service station for an inkjet printing mechanism having an ink printhead for selectively dispensing ink which is occasionally purged from the printhead, the service station comprising:

a moveable platform having a surface positionable to receive ink purged from the printhead without contacting the printhead with the platform surface for purging, wiping or capping, wherein the moveable platform comprises an endless belt having a surface which is conformable to a convex shape and to a concave shape;

a drive mechanism coupled to move the platform between a first position where the purged ink is received by the platform and a second position where the purged ink is discharged from the platform;

an ink removal device positioned to remove the purged ink from the platform surface at the second position, wherein the ink removal device comprises a discharge spindle engaging the belt at the second position with the discharge spindle being configured to conform the belt surface into the convex shape to remove the ink from the belt; and a first spindle configured to conform the belt surface into the concave shape to receive the purged ink.

2. A service station for an inkjet printing mechanism having an ink printhead for selectively dispensing ink which is occasionally purged from the printhead, the service station comprising:

a moveable platform having a surface positionable to receive ink purged from the printhead without contacting the printhead with the platform surface for purging capping or wiping;

a drive mechanism coupled to move the platform between a first position where the purged ink is received by the platform and a second position where the purged ink is discharged from the platform; and an upper spindle and a lower spindle located beneath the upper spindle during operation of the inkjet printing mechanism, with the upper spindle and the lower spindle each engaging the platform for movement between the first and second positions, with at least one of the upper and lower spindles being coupled to the drive mechanism.

3. An inkjet priming mechanism, comprising:

a media handling system for conveying print media through the printing mechanism;

an inkjet printhead for selectively dispensing ink onto portions of the print media, with the ink being occasionally purged from the printhead;

a moveable platform having a surface positionable to receive ink purged from the printhead without contacting the printhead with the platform surface for purging capping or wiping;

a drive mechanism coupled to move the platform between a first position where purged ink is received by the platform and a second position where the purged ink is discharged from the platform; and a scraper positioned to scrape the purged ink from the platform surface;

wherein the platform surface has an annular configuration for rotation by the drive mechanism about a first axis, and the annular platform includes two side wall members of a resilient material adjacent to and extending above the platform surface.

4. An inkjet printing mechanism according to claim 3 wherein:

the printing mechanism further includes a service station frame with an upper wall having an opening therethrough for receiving the purged ink from the printhead;

each side wall member has an outer rim; and the annular platform is pivotally mounted in the service station frame with the upper wall scraping any excess purged ink from the side wall member outer rims during rotation of the platform surface.

5. An inkjet printing mechanism according to claim 3 further including:

a printhead servicing device;

a tumbler body supporting the printhead servicing device, with the tumbler body being rotatable by the drive mechanism about the first axis to move the printhead servicing device into a position to service the printhead; and an axle portion extending from the tumbler body to engage and the rotate the annular configuration of the platform surface about the first axis, with the tumbler body and platform surface being located side-by-side along the first axis.

6. An inkjet printing mechanism according to claim 5 wherein the printhead servicing device comprises a wiper supported by the tumbler body to be rotatably positioned to wipe the printhead by moving the printhead relative to the wiper.

7. An inkjet printing mechanism, comprising:

a media handling system for conveying print media through the printing mechanism;

an inkjet printhead for selectively dispensing ink onto portions of the print media, with the ink being occasionally purged from the printhead;

a moveable platform having a surface positionable to receive ink purged from the printhead without contacting the printhead with the platform surface for purging, capping or wiping, wherein the moveable platform comprises an endless belt having a surface which is conformable to a convex shape;

a drive mechanism coupled to move the platform between a first position where purged ink is received by the platform and a second position where the purged ink is discharged from the platform; and an ink removal device comprising a discharge spindle engaging the belt at the second position, with the discharge spindle configured to conform the belt surface into the convex shape to remove the ink from the belt.

* * * * *

UNITED STATES PATENT AND TRADEMARK OFFICE

CERTIFICATE OF CORRECTION

PATENT NO. : 5,617,124

DATED : Apr.1, 1997

INVENTOR(S) : Bret Taylor, William S. Osborne

It is certified that error appears in the above-identified patent and that said Letters Patent is hereby corrected as shown below:

In Claim 3: line 1, the word "priming" should be omitted and replaced with the word --printing--.

Signed and Sealed this

Second Day of December, 1997

*Attest:*

Bruce Lehman

BRUCE LEHMAN

*Attesting Officer*

*Commissioner of Patents and Trademarks*